US008251706B2

(12) United States Patent
Shuai

(10) Patent No.: US 8,251,706 B2
(45) Date of Patent: Aug. 28, 2012

(54) DATA CABLE WITH SUCTION CUP AND ELECTRONIC DEVICE USING THE SAME

(75) Inventor: Huo-Ming Shuai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 33 days.

(21) Appl. No.: 12/958,271

(22) Filed: Dec. 1, 2010

(65) Prior Publication Data

US 2012/0064736 A1 Mar. 15, 2012

(30) Foreign Application Priority Data

Sep. 9, 2010 (CN) ..... 2010 1 0277213

(51) Int. Cl.
*H01R 13/60* (2006.01)

(52) U.S. Cl. ..... 439/42; 439/37; 439/930

(58) Field of Classification Search ..... 439/37, 439/39, 41, 42, 289, 930
See application file for complete search history.

(56) References Cited

U.S. PATENT DOCUMENTS 3,258,732 A * 6/1966 Martin ..... 439/280
3,267,412 A * 8/1966 Rosenberg et al. ..... 439/586
3,411,125 A * 11/1968 Hill ..... 439/41
3,783,432 A * 1/1974 Biba et al. ..... 439/41
4,204,741 A * 5/1980 Hall ..... 439/278
4,326,096 A * 4/1982 Leitmann ..... 174/84 R
4,382,650 A * 5/1983 Herrmann, Jr. ..... 439/278
4,402,560 A * 9/1983 Swainbank ..... 439/37
4,418,171 A * 11/1983 Hall ..... 524/268
4,566,746 A * 1/1986 Hobson ..... 439/588
4,582,388 A * 4/1986 Swaffield ..... 439/606
4,801,276 A * 1/1989 Thole ..... 439/592

FOREIGN PATENT DOCUMENTS

CN 2560117 Y 7/2003

* cited by examiner

*Primary Examiner* — Thanh Tam Le
(74) *Attorney, Agent, or Firm* — Altis Law Group, Inc.

(57) ABSTRACT

An electronic device includes a main body and a data cable. The main body includes a number of exposed first conductive members. The data cable includes a first data port and a second data port. The first data port is capable of being connected to an external electronic device. The second data port includes a suction cup and a plurality of second conductive members mounted within the suction cup and electrically connected to the first data port. Each second conductive member corresponds to one first conductive member. When the first data port is electrically connected to the external electronic device, and the suction cup is adhered to the main body to cause each of the second conductive members to contact the corresponding first conductive member, the electronic device is capable of sharing data with the external electronic device.

4 Claims, 3 Drawing Sheets

DATA CABLE WITH SUCTION CUP AND ELECTRONIC DEVICE USING THE SAME

BACKGROUND

1. Technical Field

The present disclosure relates to data cables and, particularly, to a data cable with a suction cup and an electronic device having the data cable.

2. Description of Related Art

Although various conventional data cables, Universal Serial Bus (USB) data cables for example, can satisfy basic requirements, a new data cable is still needed.

BRIEF DESCRIPTION OF THE DRAWINGS

The components of the drawings are not necessarily drawn to scale, the emphasis instead being placed upon clearly illustrating the principles of a data cable with a suction cup and an electronic device using the same. Moreover, in the drawings, like reference numerals designate corresponding parts throughout several views.

DETAILED DESCRIPTION

Figure 1:
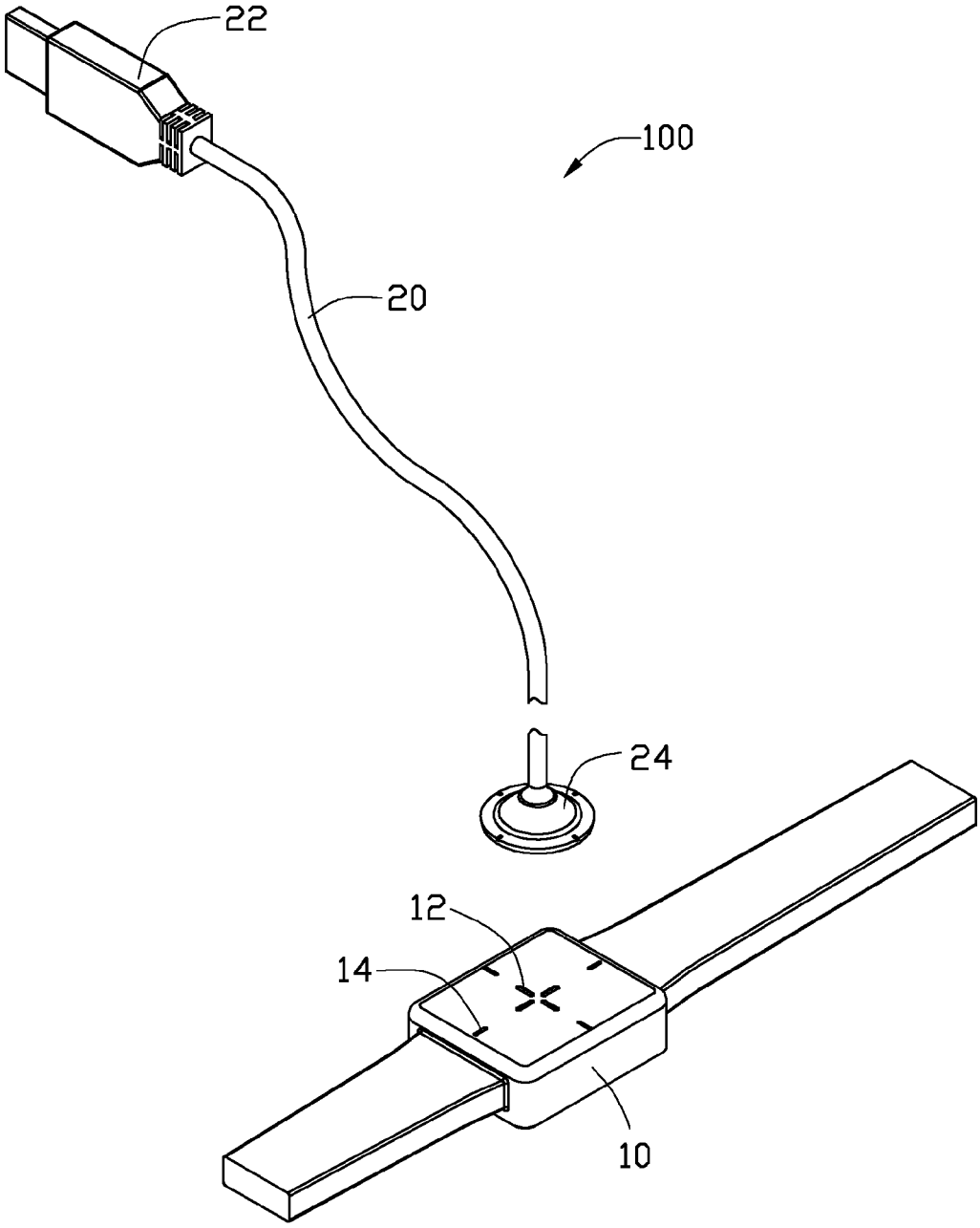
FIG. 1 is an exploded, perspective view of an electronic device with a data cable in accordance with an exemplary embodiment.
Figure 2:
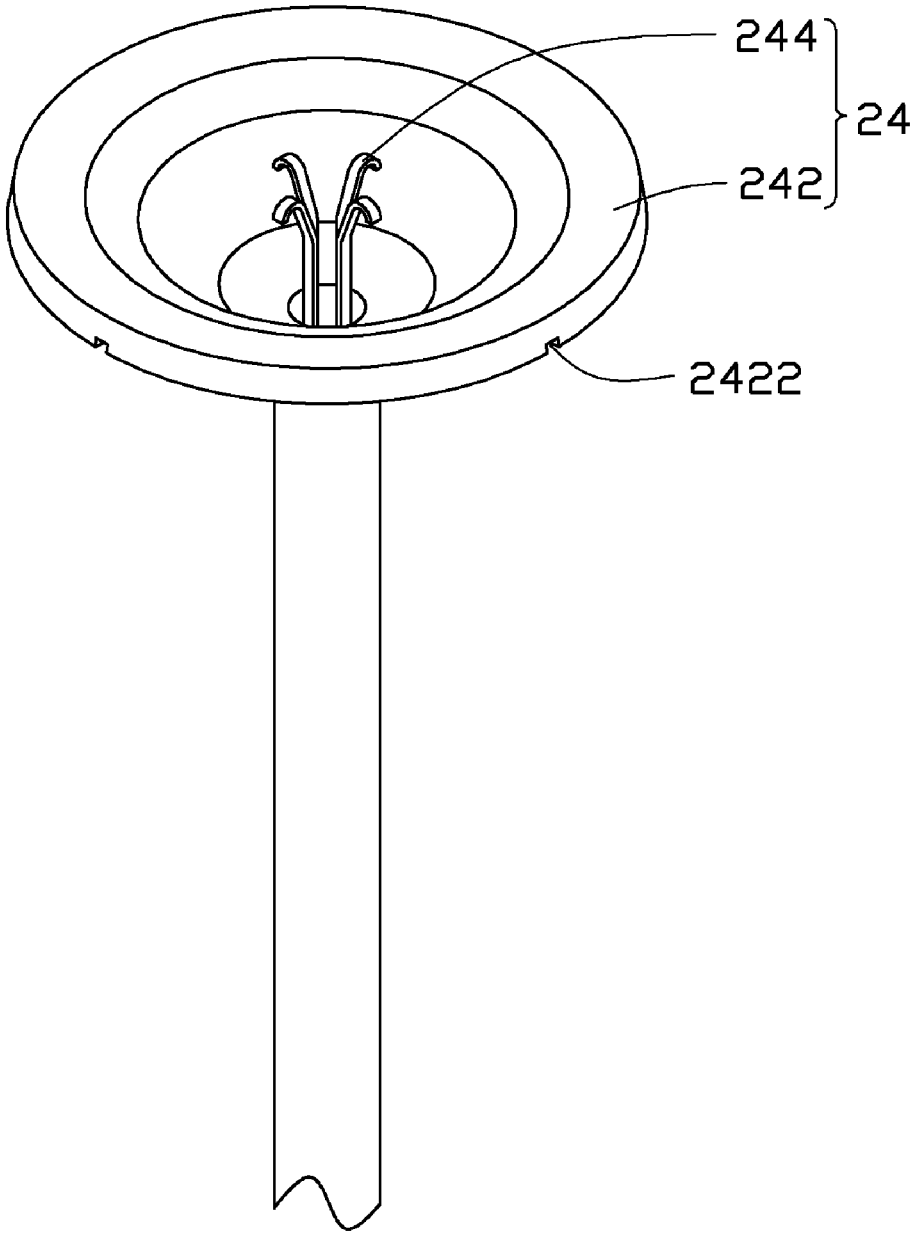
FIG. 2 is a partial, isometric view of the data cable of FIG. 1.

Referring to FIGS. 1-2, an embodiment of an electronic device 100 is illustrated. The electronic device 100 may be a wearable device or a handheld device, such as, a wristwatch, or a mobile phone. The electronic device 100 includes a main body 10 and a data cable 20.

The main body 10 includes a number of exposed first conductive members 12 electrically connected to a circuit board (not shown) mounted in the main body 10. The main body 10 further includes at least one exposed first positioning member 14. In this embodiment, the number of the at least one first positioning member 14 is equal to that of the first conductive members 12. The first positioning members 14 and the first conductive members 12 are on the same surface of the main body 10. The first positioning members 14 are further away from an axis of the main body 100 than the first conductive members 12, and each first positioning member 14 is aligned with one first conductive member 12. In this embodiment, the first positioning members 14 and the first conductive members 12 are on a back surface of the main body 100 opposite to a display (not shown) of the main body 10.

The data cable 20 includes a first data port 22 and a second data port 24. The first data port 22 can be electrically connected to an external electronic device (not shown). In this embodiment, the first data port 22 is a USB plug. The second data port 24 includes a suction cup 242 and a number of second conductive members 244 mounted in the suction cup 242. The second conductive members 244 are electrically connected to the first data port 22. The number of the second conductive members 244 is equal to that of the first conductive members 12, and each second conductive member 244 corresponds to one first conductive member 12. The suction cup 242 includes at least one exposed second positioning member 2422 each of which corresponds to one first positioning member 14.

Figure 3:
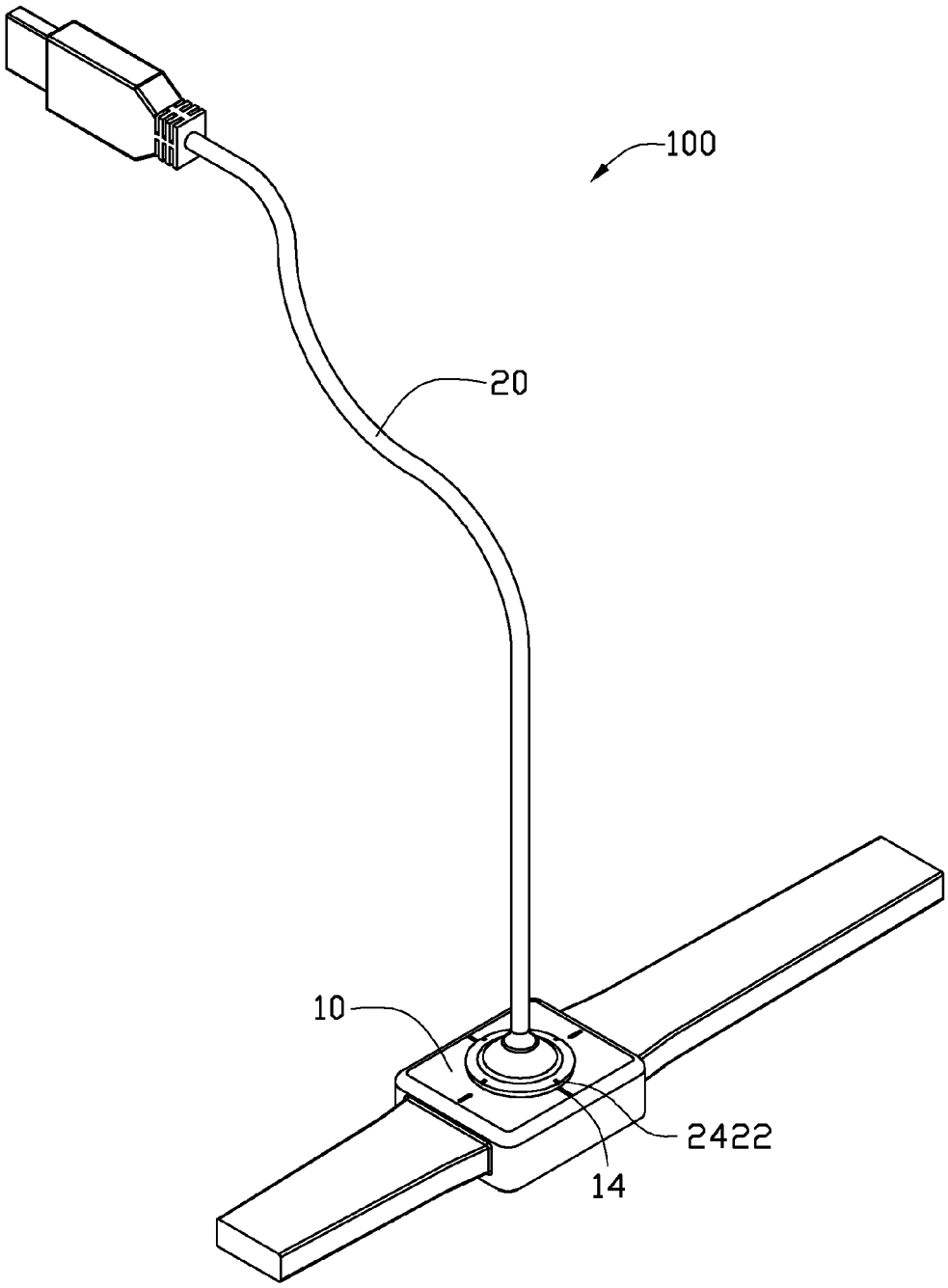
FIG. 3 is an isometric view of the electronic device of FIG. 1.

Referring to FIG. 3, when the first data port 22 is electrically connected to an external electronic device, and the suction cup 242 is adhered to the main body 10, causing each second positioning member 2422 to be aligned with the corresponding first positioning member 14 and each second conductive member 244 to contact the corresponding first conductive member 12, the electronic device 100 can share data with the external electronic device.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electronic device comprising:

a main body comprising a plurality of exposed first conductive members; and a data cable comprising:

a first data port capable of being connected to an external electronic device; and a second data port comprising a suction cup and a plurality of second conductive members mounted within the suction cup and electrically connected to the first data port, each of the second conductive members corresponding to one of the first conductive members;

wherein, when the first data port is electrically connected to the external electronic device, and the suction cup is adhered to the main body to cause each of the second conductive members to contact the corresponding first conductive member, the electronic device is capable of sharing data with the external electronic device; and wherein the main body further comprises at least one exposed first positioning member, the at least one first positioning member and the first conductive members are on the same surface of the main body, the suction cup comprises at least one exposed second positioning member, each of the at least one second positioning member corresponds to one of the at least one first positioning member, when the suction cup is adhered to the main body to cause each of the at least one second positioning member to be aligned with the corresponding first positioning member, each of the second conductive members contacts with the corresponding first conductive member.

2. The electronic device as described in claim 1, wherein the first conductive members are on a back surface of the main body.

3. The electronic device as described in claim 1, wherein the electronic device is a wristwatch.

4. The electronic device as described in claim 3, wherein the first conductive members are on a back surface of the wristwatch.

* * * * *